US008837762B2

(12) United States Patent
Tada

(10) Patent No.: US 8,837,762 B2
(45) Date of Patent: Sep. 16, 2014

(54) SPEAKER

(71) Applicant: Alpine Electronics, Inc., Tokyo (JP)

(72) Inventor: Arata Tada, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 13/690,578

(22) Filed: Nov. 30, 2012

(65) Prior Publication Data

US 2013/0142380 A1 Jun. 6, 2013

(30) Foreign Application Priority Data

Dec. 5, 2011 (JP) ..... 2011-265989

(51) Int. Cl.

| | |
|---|---|
| ***H04R 1/28*** | (2006.01) |
| ***H04R 9/06*** | (2006.01) |
| ***H04R 1/34*** | (2006.01) |
| ***H04R 9/02*** | (2006.01) |
| *H04R 1/22* | (2006.01) |

(52) U.S. Cl.

CPC ..... *H04R 9/025* (2013.01); *H04R 9/06* (2013.01); *H04R 1/22* (2013.01); *H04R 1/345* (2013.01); *H04R 2499/13* (2013.01)

USPC ..... 381/337; 381/339; 381/345; 381/351; 381/389; 381/396

(58) Field of Classification Search

USPC ..... 381/86, 87, 332, 334–340, 345, 150, 381/161, 385, 386, 388, 389, 190, 396, 413

See application file for complete search history.

(56) References Cited

U.S. PATENT DOCUMENTS

| | | | | |
|---|---|---|---|---|
| 6,658,127 | B1 * | 12/2003 | Kim | 381/340 |
| 8,139,783 | B2 * | 3/2012 | Schuster et al. | 381/86 |
| 2005/0013459 | A1 * | 1/2005 | Maekawa | 381/349 |
| 2011/0116678 | A1 * | 5/2011 | Wang | 381/407 |

FOREIGN PATENT DOCUMENTS

WO WO 2011/047435 A1 4/2011

OTHER PUBLICATIONS

Loudspeaker and Headphone Handbook, Third Edition, Jan. 1, 2001, Focal Press, XP002719605, p. 45, figure 2.2.

Extended European Search Report for EP 12195258.4, dated Feb. 13, 2014, (6 pps.)

* cited by examiner

*Primary Examiner* — Brian Ensey
*Assistant Examiner* — Sabrina Diaz
(74) *Attorney, Agent, or Firm* — Brinks Gilson & Lione

(57) ABSTRACT

In a speaker, a space surrounded by a frame on one side of a diaphragm is separated by a damper into a first internal space and a second internal space. The first internal space and the second internal space are caused to face one part and another part of an opening provided in the frame. A duct protrudes from the frame, and the opening is an open end of the duct on the base end side thereof. The speaker is installed, for example, outside a vehicle cabin with the duct inserted into an opening in a vehicle cabin wall, and the first and second internal spaces are caused to communicate with a space in the vehicle cabin through the duct. Therefore, reproduced sound in the bass range having a high sound pressure can be discharged through the duct to the space in the vehicle cabin.

15 Claims, 3 Drawing Sheets

SPEAKER

RELATED APPLICATION

The present application claims priority to Japanese Patent Application Number 2011-265989, filed Dec. 5, 2011, the entirety of which is hereby incorporated by reference.

BACKGROUND

1. Field of the Invention

The present invention relates to a speaker that applies current to a voice coil and thereby vibrates a diaphragm, and more specifically, it relates to a speaker suitable to be installed, for example, in a bumper outside a vehicle cabin.

2. Description of the Related Art

Installing a relatively large speaker, such as a subwoofer for the bass range, in a vehicle cabin reduces the usable space in the vehicle cabin. So, in recent years, a technique has been used in which a speaker is installed inside a member (for example, a bumper) outside a vehicle cabin, and reproduced sound emitted from this speaker is discharged through an opening portion provided in a vehicle cabin wall (body) to the space in the vehicle cabin.

Causing the diaphragm of the speaker to face the opening portion in the vehicle cabin wall when the speaker is installed outside the vehicle cabin enables reproduced sound in the bass range having a high sound pressure to be discharged through the opening portion to the inside of the vehicle cabin without hindrance. However, a member outside the vehicle cabin does not have therein a large storage space like the space in the vehicle cabin, and therefore the diaphragm of the speaker often cannot be caused to face the opening portion in the vehicle cabin wall.

In order to solve this problem, there has been proposed a technique in which a cylindrical duct is provided so as to protrude from the outer peripheral surface of a cone-shaped frame holding the outer periphery of a diaphragm, this duct is inserted into an opening portion in a vehicle cabin wall, and a speaker installed outside a vehicle cabin is caused to communicate with the space in the vehicle cabin through the duct.

As described above, in the related art, an internal space defined by the diaphragm, the damper, and the frame is caused to face an open end of the duct. However, this open end cannot be very large. Therefore, although reproduced sound in the bass range having a high sound pressure is discharged through the duct, high sound quality cannot be expected. In such a conventional speaker, because a cylindrical duct protrudes from the outer peripheral surface of a cone-shaped frame, a duct having a reduced internal diameter at its open end needs to be provided so as to be continuous with the outer peripheral surface of the frame. In order to discharge reproduced sound in the bass range having a high sound pressure at high sound quality, the duct needs to have at least a certain internal diameter. Therefore, when a speaker provided with a duct such as that of the conventional art is a bass speaker such as a subwoofer and is installed outside a vehicle cabin, high sound quality is not obtained. Another special measure needs to be taken.

SUMMARY

The present invention is made in view of the above problem of the conventional art, and it is an object of the present invention to provide a speaker capable of discharging reproduced sound in the bass range having a high sound pressure through a duct at high sound quality.

To attain the above object, in one embodiment of the present invention, a speaker includes a magnetic circuit having a magnetic gap, a voice coil disposed in the magnetic gap and driven by electromagnetic interaction when current is applied to the voice coil, a diaphragm that vibrates in conjunction with the voice coil, a damper that elastically supports the voice coil and the diaphragm, a frame that holds the outer periphery of the diaphragm and the outer periphery of the damper, and a duct protruding from the frame, an open end of the duct on the distal end side thereof facing an external space, an opening provided in the frame being an open end of the duct on the base end side thereof, wherein a space surrounded by the frame on one side of the diaphragm is separated by the damper into a first internal space and a second internal space, the first internal space is caused to face one part of the opening, the second internal space is caused to face another part of the opening, and thereby the first and second internal spaces are caused to communicate with the external space.

In the speaker configured as above, because the first and second internal spaces on one side and the other side of the damper are caused to face one part and another part of the opening in the frame communicating with the external space through the duct, the diameter of the opening in the frame is large and the duct is large. Therefore, if this speaker is a bass speaker, reproduced sound in the bass range having a high sound pressure produced by vibrating the diaphragm can be discharged through the large-diameter opening and duct at high sound quality to the external space. Since both the first and second internal spaces are caused to communicate with the external space through the duct, the damper can operate smoothly, and the distortion of reproduced sound can be easily suppressed. Therefore, this speaker is suitable as an automotive subwoofer installed outside a vehicle cabin in order to secure a large space in the vehicle cabin.

In the above configuration, a reinforcement rib may be provided at the base end of the duct, and the reinforcement rib may hold the outer periphery of the damper at a position where the reinforcement rib extends across the opening. In this case, the outer periphery of the damper can be reliably held by the reinforcement rib in the opening where the frame does not exist. Therefore, in the case where the sound pressure of reproduced sound is high, the operation of the damper can be easily stabilized.

DESCRIPTION OF THE PREFERRED EMBODIMENTS

Figure 1:
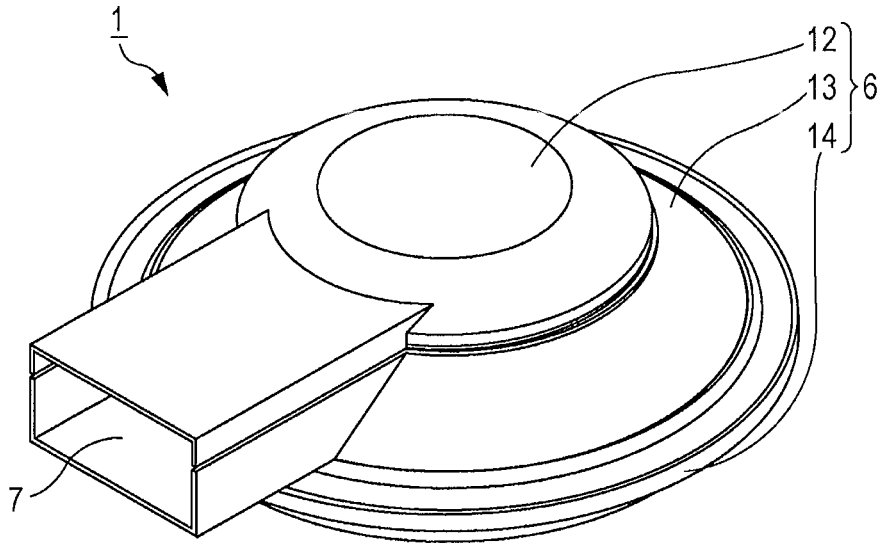
FIG. 1 is an external perspective view of a speaker according to a first embodiment of the present invention from the top thereof.
Figure 2:
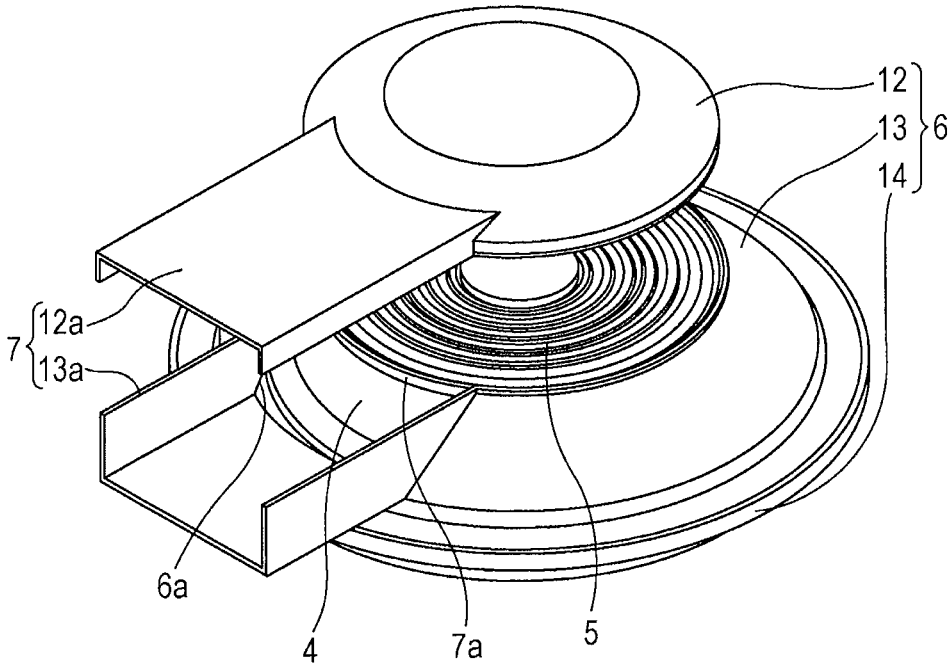
FIG. 2 is an exploded perspective view corresponding to FIG. 1.
Figure 3:
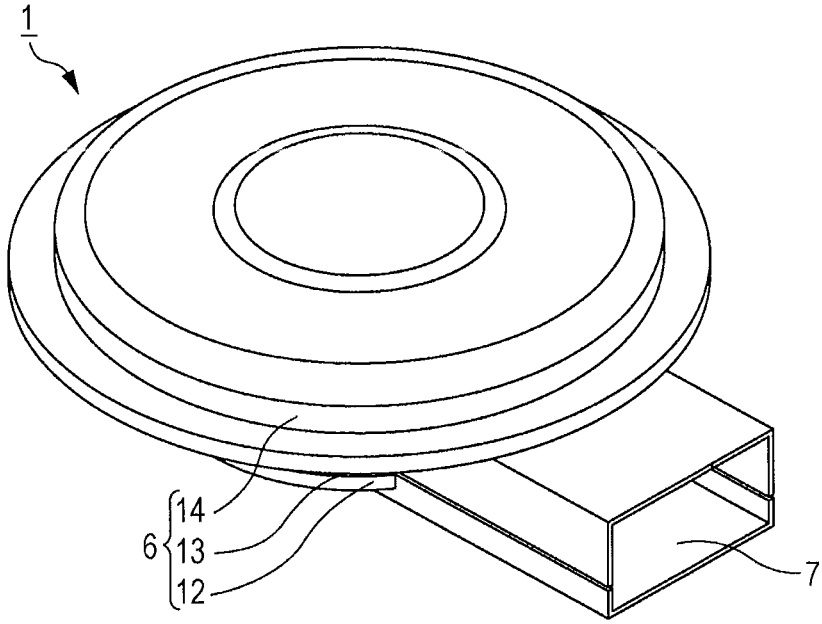
FIG. 3 is an external perspective view of the speaker from the bottom thereof.
Figure 4:
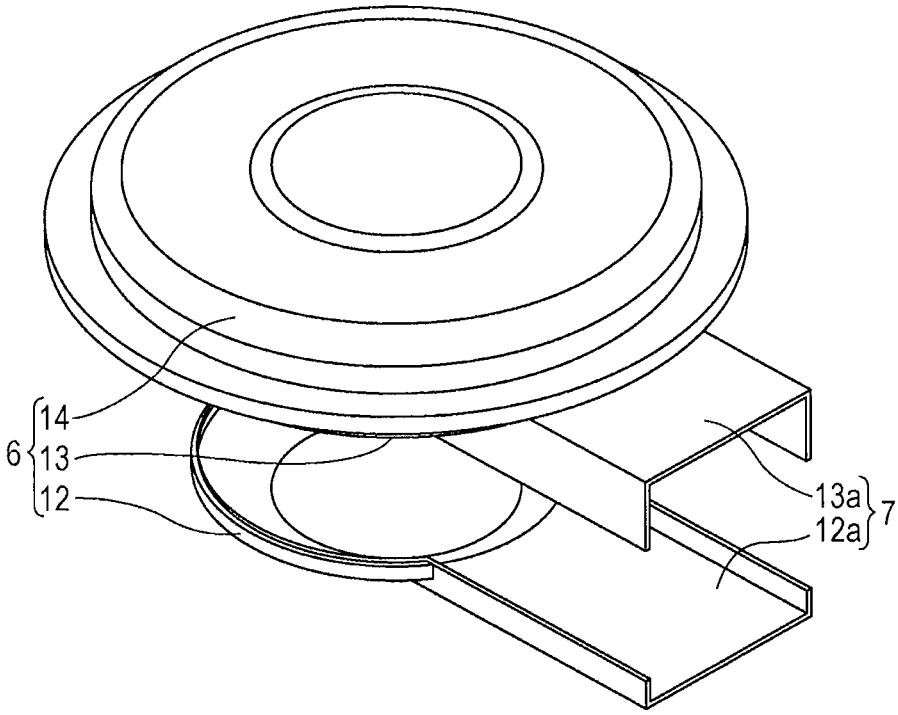
FIG. 4 is an exploded perspective view corresponding to FIG. 3.

Embodiments of the present invention will be described with reference to the drawings. As shown in FIG. 1 to FIG. 5, a speaker 1 according to a first embodiment of the present invention is an automotive subwoofer installed, for example, in a bumper outside a vehicle cabin of an automobile, and reproduced sound is discharged through a duct 7 to a space 32 in the vehicle cabin (see FIG. 5). The speaker 1 mainly includes a magnetic circuit 2 having a magnetic gap G, a voice coil 3 disposed in the magnetic gap G and driven by electromagnetic interaction when current is applied to the voice coil 3, a substantially cone-shaped diaphragm 4 that vibrates in conjunction with the voice coil 3, an annular damper 5 that elastically supports the voice coil 3 and the diaphragm 4, a frame 6 that holds the outer periphery of the diaphragm 4 and the outer periphery of the damper 5, and a rectangular tubular duct 7 protruding from the frame 6.

The magnetic circuit 2 has a magnet 8 and a yoke 9 that form a magnetic path. Magnetic flux flowing along this magnetic path crosses the magnetic gap G. The voice coil 3 is wound on a cylindrical bobbin 10. The inner periphery of the diaphragm 4 and the inner periphery of the damper 5 are bonded to the upper end of the bobbin 10. The outer periphery of the diaphragm 4 is held by the frame 6 with an edge member 11 therebetween. The frame 6 is a box-like body formed by integrating an upper frame 12, an intermediate frame 13, and a lower frame 14. The intermediate frame 13 holds the outer periphery of the damper 5. The lower frame 14 is fastened to the yoke 9. The duct 7 is a tubular body formed by joining together a protruding piece 12*a* extending outwardly from the upper frame 12 and a protruding piece 13*a* extending outwardly from the intermediate frame 13. Cutouts in the frames 12 and 13 form an opening 6*a* in the frame 6. The opening 6*a* is an open end of the duct 7 on the base end side thereof. A reinforcement rib 7*a* is provided at the base end of the duct 7. The reinforcement rib 7*a* holds the outer periphery of the damper 5 at a position where the reinforcement rib 7*a* extends across the opening 6*a* (see FIG. 2).

Figure 5:
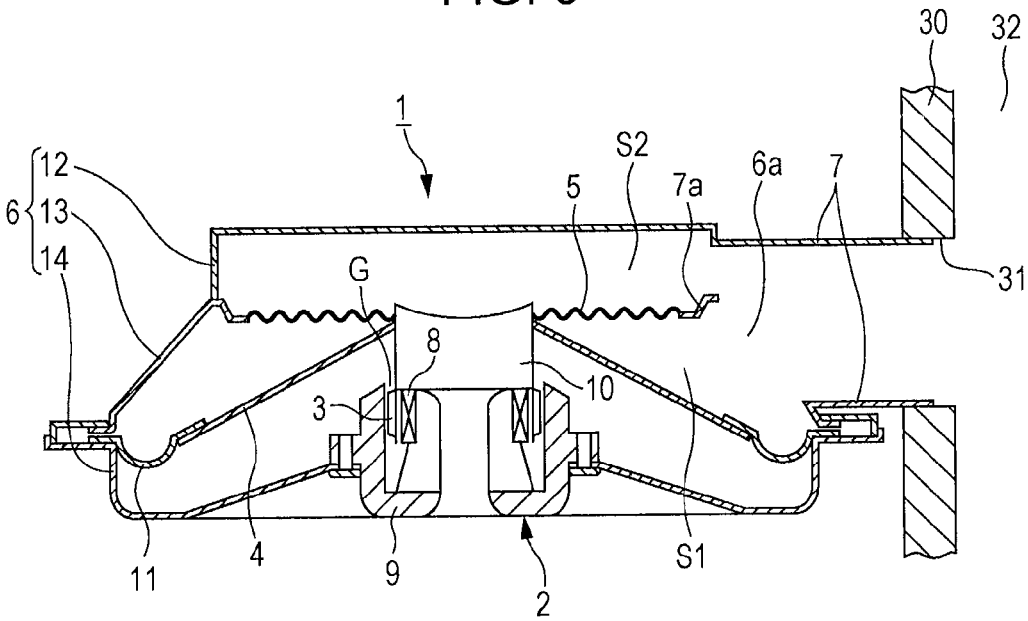
FIG. 5 is a sectional view showing the speaker in an installed state.

In the speaker 1, a space surrounded by the upper frame 12 and the intermediate frame 13 on the upper side of the diaphragm 4 is separated by the damper 5 into a lower first internal space S1 and an upper second internal space S2. As shown in FIG. 5, the first internal space S1 faces part of the opening 6*a* below the reinforcement rib 7*a*, and the second internal space S2 faces part of the opening 6*a* above the reinforcement rib 7*a*. The duct 7 is inserted into an opening 31 provided in a vehicle cabin wall 30, and an open end of the duct 7 on the distal end side thereof faces a space 32 in the vehicle cabin. Therefore, both the first and second internal spaces S1 and S2 of the speaker 1 installed, for example, inside a bumper outside the vehicle cabin are caused to communicate with the space 32 in the vehicle cabin through the opening 6*a* and the duct 7.

In the speaker 1 configured as above, when voice current is applied to the voice coil 3 disposed in the magnetic gap G, the voice coil 3 is driven up and down by the known electromagnetic interaction. By the diaphragm 4 that vibrates in conjunction with the voice coil 3, air in the first and second internal spaces S1 and S2 is vibrated and discharges reproduced sound. Since both the first and second internal spaces S1 and S2 face the opening 6*a*, which is an open end of the duct 7 on the base end side thereof, the reproduced sound produced in the speaker 1 is discharged through the duct 7 to the space 32 in the vehicle cabin.

In the speaker 1 according to this embodiment, because the first internal space S1 and the second internal space S2 are caused to face one part and the other part of the opening 6*a*, the diameter of the opening 6*a* is large and the duct 7 is large. Therefore, reproduced sound in the bass range having a high sound pressure produced by vibrating the diaphragm 4 can be discharged through the large-diameter opening 6*a* and duct 7 at high sound quality to the space 32 in the vehicle cabin. Since both the first and second internal spaces S1 and S2 are caused to communicate with an external space (the space 32 in the vehicle cabin) through the duct 7, the damper 5 can operate smoothly, and the distortion of reproduced sound can be easily suppressed.

In the speaker 1 according to this embodiment, because the reinforcement rib 7*a* holding the outer periphery of the damper 5 is provided at the base end of the duct 7, the outer periphery of the damper 5 can be reliably held by the reinforcement rib 7*a* in the opening 6*a* where the frame 6 does not exist. Therefore, in the case where the sound pressure of reproduced sound is high, the operation of the damper 5 can be easily stabilized.

Figure 6:
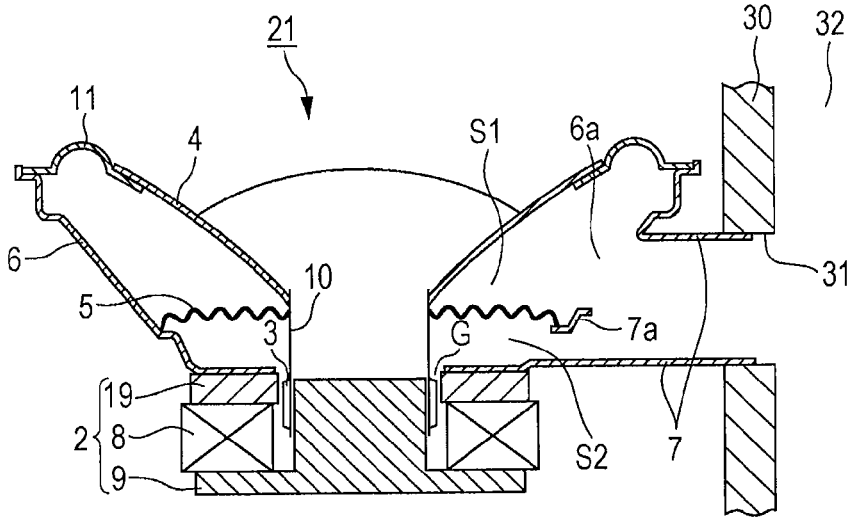
FIG. 6 is a sectional view showing a speaker according to a second embodiment of the present invention in an installed state.

Next, a speaker 21 according to a second embodiment of the present invention will be described with reference to FIG. 6. In FIG. 6, the same reference numerals are used to designate components corresponding to those in FIG. 1 to FIG. 5.

In the speaker 21 according to the second embodiment, a diaphragm 4 is disposed above a damper 5, and a magnetic circuit 2 and a frame 6 differ in structure from those in the first embodiment. For example, in the magnetic circuit 2 of the speaker 21, a magnetic gap G is formed inside a top plate 19 placed on and fixed to a magnet 8, and the frame 6 of the speaker 21 is formed of a single member and does not cover the diaphragm 4.

Also in this speaker 21, however, an opening 6*a* in the frame 6 is an open end of a duct 7 on the base end side thereof, a reinforcement rib 7*a* holding the outer periphery of the damper 5 is provided at the base end of the duct 7, and the duct 7 is inserted into an opening portion 31 in a vehicle cabin wall 30. Also in the speaker 21, a space surrounded by the frame 6 on one side of the diaphragm 4 is separated by the damper 5 into a first internal space S1 and a second internal space S2, and the first internal space S1 and the second internal space S2 are caused to face one part and the other part of the opening 6*a*. Therefore, reproduced sound in the bass range having a high sound pressure produced by vibrating the diaphragm 4 can be discharged through the large-diameter opening 6*a* and duct 7 at high sound quality to the space 32 in the vehicle cabin, and the damper 5 can operate smoothly, and the distortion of reproduced sound can be easily suppressed.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

The invention claimed is:

1. A speaker comprising:

a magnetic circuit having a magnetic gap;

a voice coil disposed in the magnetic gap and driven by electromagnetic interaction when current is applied to the voice coil;

a diaphragm that vibrates in conjunction with the voice coil;

a damper that elastically supports the voice coil and the diaphragm;

a frame that holds the outer periphery of the diaphragm and the outer periphery of the damper; and a duct protruding from the frame, an open end of the duct on the distal end side thereof facing an external space, wherein the frame has a substantially closed surface on a side of the diaphragm that faces the damper, except for an opening provided in the frame being an open end of the duct on the base end side thereof, wherein a space surrounded by the frame on one side of the diaphragm is separated by the damper into a first internal space and a second internal space, the first internal space is facing one part of the opening, the second internal space is facing another part of the opening, and thereby the first and second internal spaces are caused to communicate with the external space.

2. The speaker according to claim 1, wherein a reinforcement rib is provided at the base end of the duct, and the reinforcement rib holds the outer periphery of the damper at a position where the reinforcement rib extends across the opening.

3. The speaker according to claim 2, wherein the duct protrudes from the frame in a lateral direction.

4. The speaker according to claim 3, wherein the duct has a generally rectangular cross-section.

5. The speaker according to claim 4, wherein the distal end side of the duct is configured to be inserted into an opening in a wall.

6. The speaker according to claim 1, wherein a portion of the frame substantially encloses the damper and the side of the diaphragm that faces the damper, and another portion of the frame substantially encloses an opposite side of the diaphragm.

7. A speaker comprising:

a voice coil disposed on a bobbin;

a substantially cone-shaped diaphragm secured to the bobbin;

a damper elastically supporting the bobbin and the diaphragm;

a frame securing the outer periphery of the diaphragm and the outer periphery of the damper and substantially enclosing the damper and a side of the diaphragm that faces the damper, wherein the frame has a substantially closed surface on the side of the diaphragm that faces the damper, except for an opening; and a duct extending from the opening in the frame to an external space;

wherein a space surrounded by the frame on one side of the diaphragm is separated by the damper into a first internal space and a second internal space, the first internal space is facing one part of the opening, the second internal space is facing another part of the opening, and thereby the first and second internal spaces are caused to communicate with the external space.

8. The speaker according to claim 7, wherein the duct protrudes from the frame in a lateral direction.

9. The speaker according to claim 8, wherein the duct has a generally rectangular cross-section.

10. The speaker according to claim 9, wherein the distal end side of the duct is configured to be inserted into an opening in a wall.

11. The speaker according to claim 7, wherein a portion of the frame substantially encloses the damper and the side of the diaphragm that faces the damper, and another portion of the frame substantially encloses an opposite side of the diaphragm.

12. A speaker for supplying sound to a cabin of a vehicle through a wall of the vehicle cabin, comprising:

a voice coil disposed on a bobbin;

a diaphragm secured to the bobbin;

a damper elastically supporting the bobbin and the diaphragm;

a frame securing the outer periphery of the diaphragm and the outer periphery of the damper and substantially enclosing the damper and a side of the diaphragm that faces the damper, wherein the frame has a substantially closed surface on the side of the diaphragm that faces the damper, except for an opening; and a duct extending from the opening in the frame to an opening in the wall of the vehicle cabin so that sound produced by the speaker is supplied to the vehicle cabin;

wherein a space surrounded by the frame on one side of the diaphragm is separated by the damper into a first internal space and a second internal space, the first internal space is facing one part of the opening, the second internal space is facing another part of the opening, and thereby the first and second internal spaces are caused to communicate with an external space.

13. The speaker according to claim 12, wherein the duct protrudes from the frame in a lateral direction.

14. The speaker according to claim 13, wherein the duct has a generally rectangular cross-section.

15. The speaker according to claim 12, wherein a portion of the frame substantially encloses the damper and the side of the diaphragm that faces the damper, and another portion of the frame substantially encloses an opposite side of the diaphragm.

* * * * *